US007040508B2

(12) United States Patent
Woersdoerfer et al.

(10) Patent No.: US 7,040,508 B2
(45) Date of Patent: May 9, 2006

(54) DISPENSING SYSTEM AND SQUEEZING-OUT DEVICE AND STORAGE CONTAINER FOR THE DISPENSING SYSTEM

(75) Inventors: Udo Woersdoerfer, Landsberg (DE); Markus Koegler, Buchloe (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/840,158

(22) Filed: May 6, 2004

(65) Prior Publication Data

US 2005/0029293 A1 Feb. 10, 2005

(30) Foreign Application Priority Data

May 13, 2003 (DE) ..... 103 21 322

(51) Int. Cl.
*B65D 35/22* (2006.01)

(52) U.S. Cl. ..... 222/94; 222/102; 222/101; 222/145.1

(58) Field of Classification Search ..... 222/101, 222/102, 94, 145.1
See application file for complete search history.

(56) References Cited

U.S. PATENT DOCUMENTS

| | | | | |
|---|---|---|---|---|
| 2,901,147 | A * | 8/1959 | Bond, Jr. | 222/102 |
| 3,265,249 | A * | 8/1966 | Sture | 222/101 |
| 3,543,966 | A * | 12/1970 | Shapero et al. | 222/94 |
| 4,125,206 | A * | 11/1978 | Wilson | 222/101 |
| 4,998,645 | A * | 3/1991 | Pearson | 222/98 |
| 5,848,730 | A * | 12/1998 | Kawase et al. | 222/94 |

* cited by examiner

*Primary Examiner*—Philippe Derakshani
(74) *Attorney, Agent, or Firm*—Abelman, Frayne & Schwab

(57) ABSTRACT

A system for dispensing at least two components of a multicomponent mass, includes a squeezing-out device (2) having a dispensing opening (4) and at least one rolling roller (3.1, 3.2) for dispensing the at least two components; a storage container (11) having flat support element (13) on which packagings of the at least two components are supported; and a spring (8.1, 8.2) for biasing the at least one rolling roller (3.1, 3.2) in a direction toward the flat support element (13) substantially perpendicular thereto.

7 Claims, 4 Drawing Sheets

Fig. 1
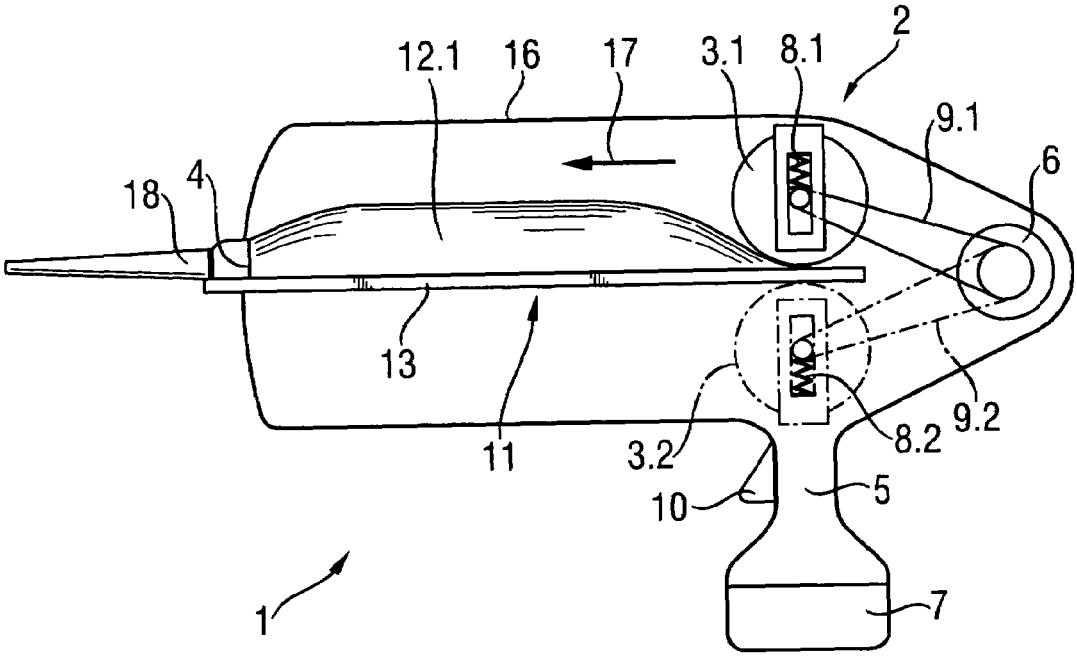
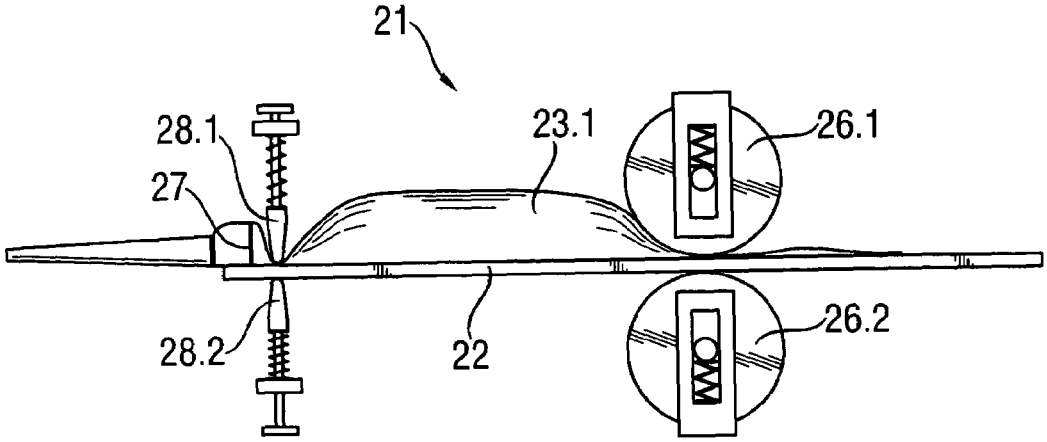
Fig. 2

DISPENSING SYSTEM AND SQUEEZING-OUT DEVICE AND STORAGE CONTAINER FOR THE DISPENSING SYSTEM

BACKGROUND OF THE INVENTION

1. Field of the Invention

The invention relates to a system for dispensing at least two components of a multicomponent compound and which comprises a squeezing-out mechanism and a storage container. The squeezing-out mechanism has a dispensing opening and at least one rollable roller for dispensing the components. At least two components of the multicomponent compounds, which can be dispensed by the squeezing-out mechanism, are arranged on the storage container. Further, the invention is directed to a squeezing-out mechanism, particularly for a system of the type mentioned above, and a storage container for at least two components of a multicomponent compound, particularly for a system of the type described above.

2. Description of the Prior Art

U.S. Pat. No. 3,302,832 A, e.g., discloses mechanism for squeezing-out a two-component compound whose individual components are packaged in tubes, wherein the tubes are pressed simultaneously by rolling up the rear, closed ends of the tubes. Another squeezing-out mechanism for a two-component compound, in which two tubes are pressed simultaneously, is known, e.g., from U.S. Pat. No. 3,187,951 A. In this device, the tubes are pressed between two rollers which are coupled to one another.

A disadvantage in these systems consists in a costly replacement of empty tubes with new, filled tubes by the user. Further, due to the components being packaged in tubes, there is a large amount of packaging material to be recycled in proportion to the dispensed compound so that these systems are not suitable for commercial use, e.g., for filling a plurality of bore-holes.

Modern systems used for dispensing two-component compounds mostly have a plastic cartridge and a squeezing-out mechanism. The cartridge has two tubular elements which are filled separately with the individual components. The squeezing-out mechanism is outfitted with a squeezing-out device which dispenses the substances from the cartridge, e.g., by means of a plunger and connecting rod. An outlet channel with a static mixer is provided at the dispensing opening of the squeezing-out mechanism for mixing the components. The squeezing-out mechanism can be operated mechanically, pneumatically or hydraulically.

The known solution is disadvantageous in that with more than two components to be dispensed, the construction of the known squeezing-out mechanisms becomes more complicated and, therefore, more costly to produce, which has disadvantageous results particularly with respect to performance capability and manufacturing costs. In addition, usually only constant dispensing ratios can be dispensed with these systems. Nested packaging, e.g., a foil bag within a foil bag, is only suitable for constant dispensing ratios of the components.

It is the object of the present invention to provide a system which comprises a squeezing-out mechanism and a storage container and with which more than two components of a multicomponent compound can be dispensed.

Another object of the present invention is to provide a system of the type described above in which the dispensing ratios of the individual components are variable.

A further object of the present invention is a system as well as the squeezing-out mechanism and the storage container which are simple and economical to produce.

SUMMARY OF THE INVENTION

These and other objects of the present invention, which will become apparent hereinafter, are achieved by providing a system for dispensing at least two components of a multicomponent compound including a squeezing-out mechanism and a storage container and in which the squeezing-out mechanism has a dispensing opening and at least one rollable or rolling roller for dispensing the components. At least two components of the multicomponent compounds, which can be dispensed by the squeezing-out mechanism, are arranged on the storage container, and the storage container has a flat supporting structure on which the at least two components are arranged in separate packagings, with the at least one roller of the squeezing-out mechanism movable substantially perpendicular toward the flat supporting structure by a spring force.

With the system according to the invention, different multicomponent compounds can be dispensed with one squeezing-out device. The storage container is preferably constructed as an exchangeable module of the system. In order to dispense a multicomponent sealing compound, e.g., the storage container has the corresponding quantity of components which are arranged in suitable packagings on the storage container and which are squeezed out by means of the rolling roller. The at least one roller moves from a starting position in the direction of the dispensing opening during the squeezing-out process. In order to press out a multicomponent adhesive compound, a storage container having the corresponding components of the multicomponent adhesive compound arranged on its flat supporting structure is inserted into the squeezing-out mechanism.

Due to the fact that the at least one roller of the squeezing-out device is biased in a spring-elastic manner so that the at least one roller is movable substantially perpendicular toward the flat supporting structure, the pressure on the flat surface structure remains perpendicular to the dispensing direction during the squeezing-out process so that the components arranged on the storage container cannot evade the pressure of the at least one roller in the direction opposite to the dispensing direction. The component compounds are used up in their entirety. The system according to the invention is distinguished by the various possibilities of use, on one hand, and by its economical efficiency compared with the known systems, on the other hand.

A squeezing-out mechanism, according to the invention, particularly for use in the system, according to the invention, with a storage container, according to the invention, for dispensing at least two components of a multicomponent compound has driving means and a dispensing opening. The driving means moves at least one roller which is movable or rolls in the direction of the dispensing opening and with of which the components of the multicomponent compound can be dispensed. The at least one roller is movable substantially perpendicular toward the flat supporting structure by a spring force.

The components of the multicomponent compound can be dispensed or squeezed out of the packaging containers by the rolling roller. A squeezing-out mechanism according to the invention does not include a connecting rod and plunger as dispensing mechanism, so that it can be constructed in a simpler, more compact manner compared to the known squeezing-out mechanisms for a plurality of components.

The pressure perpendicular to the dispensing direction or substantially perpendicular to the flat supporting structure is maintained by a spring force, so that the component compound can not evade the pressure of the at least one roller in the direction opposite to the dispensing direction during the squeezing-out process. The at least one roller is biased in a spring-elastic manner by a compression spring or a tension spring, e.g., in addition, irregularities or any deformations in the packaging of the individual components or flat supporting structure can be compensated by a roller which is supported in a spring-elastic manner, so that the at least one roller cannot jam during the squeezing-out process. All of the component substances are completely used up, which is advantageous particularly with the high material costs of the individual components and, therefore, of the dispensed multicomponent compound.

The at least one roller is preferably cylindrical. This shape of the roller ensures a continuous dispensing of the corresponding components. However, the roller can have a different shape, e.g., a conical or elliptical shape, for disproportionate dispensing of one or more components. The flat supporting structure can be provided, e.g., with a depression; with the roller having a surface substantially complementary to the depression so that it slides along in this depression.

The squeezing-out mechanism preferably has at least two rollers. The rollers are, e.g., arranged opposite from one another and are coupled together and driven in a controlled manner, the packagings of the individual components lying between these rollers. This construction of the squeezing-out mechanism according to the invention ensures that the components stored in the containers are completely used up, particularly when the containers containing the components of the multicomponent compound are easily deformable. Accordingly, e.g., the flat supporting structure can have a small thickness which is adapted to the storage containers so as to economize on material.

The rotating speed of the rollers can preferably be controlled separately. A separately controllable roller can be assigned to each component to be dispensed. The forward feed of the individual rollers is determined depending on local conditions, e.g., the prevailing temperature or humidity at the location of use, and depending on the material characteristics of the individual components, e.g., viscosity, so that the individual components are dispensed under optimal conditions adapted to local factors. The adjustment of the rotating speed of the individual rollers can be carried out, e.g., by means of a mechanical control (e.g., by means of an adjusting lever) or an electronic control (e.g., a sensor).

The driving means advantageously comprises an electric motor which drives the at least one roller. The electric motor is supplied with power via a main power supply line or by a power source that can be used anywhere (e.g., a storage battery). A transmission device is preferably provided between the driving means and the at least one roller. Various gear ratios can be realized by means of the transmission device, e.g., a transmission rod assembly. Accordingly, different multicomponent compounds, e.g., with different viscosities of the individual components, can be dispensed by the driving means by one and the same squeezing-out mechanism according to the invention. When the squeezing-out device has two rollers, the rollers are either moved synchronously or driven by two separate transmission devices by the driving means. Another variant for driving two rollers is the arrangement of two motors serving as driving means, each motor moving a roller in such a way that it is controlled independently from the other. Instead of an electric motor, the driving means can also comprise a pneumatic or hydraulic motor.

The dispensing opening preferably has, e.g., a tubular, outlet sleeve as outlet channel so that the to-be-dispensed multicomponent compound can be placed accurately at the application site. In order to prevent the multicomponent compound or individual components from flowing out or continuing to flow in an undesirable manner, a device is advantageously provided for closing the dispensing opening and an outlet channel which is provided at the dispensing opening. During a pause in operation, the containers holding the components can be closed by the closing device to prevent a reaction between the components or contact with air. The closing device comprises, e.g., a slide which is pretensioned in a spring-elastic manner and which closes the corresponding packaging by compressing the packaging.

When there is a plurality of components, a separately controllable closing device may be provided for each component packaging, so that the components can be combined depending on the characteristic of the dispensed multicomponent compound. E.g., if the multicomponent compound comprises a maximum of five components, all of which necessarily need to be combined only under extreme temperature conditions, the combination of three components can be sufficient under other boundary conditions. The two components not required for this application remain closed during this dispensing process.

A mixing element can preferably be arranged in an exchangeable manner at the end of the squeezing-out mechanism with the dispensing opening. A static mixer which is made of plastic, e.g., is advantageously used in the outlet sleeve as mixing element and can be exchanged along with the outlet sleeve after an interruption of operation. After the components are combined, they usually harden and render the mixing element unusable so that it must be changed before reuse.

Before being mixed, the components are stored in separate packaging on a storage container, according to the invention, for storing at least two components of a multicomponent compound. The storage container has a flat supporting structure at which the at least two packagings of the components are arranged. The maximum quantity of packagings, and therefore the maximum quantity of components, required for mixing the multicomponent compound can be arranged on the flat supporting structure. Compared to a known solution using a cartridge, e.g., the storage container according to the invention offers a more flexible arrangement of the components. When the storage container has a standardized design, various types of multicomponent compounds can be stored and put to use on this modular storage container.

Particularly when using the storage container in the system according to the invention, e.g., with a squeezing-out mechanism according to the invention, the at least one roller can roll along the flat supporting structure. When two rollers are provided opposite one another in the squeezing-out mechanism, the flat supporting structure can be constructed with a small thickness so as to economize on material, since the flat supporting structure need not absorb any bending resistance due to the rollers acting on it and is dimensioned primarily based on loading as a supporting structure for the packagings and storage.

The flat supporting structure preferably has guide means or orientation means for preventing incorrect insertion of the storage container, particularly in a squeezing-out mechanism according to the invention. The guide means or orientation means for insertion of the storage container in the correct position ensures that no operating errors on the part of the user can occur, particularly in a modular construction of the storage container as part of the system according to the invention. When the storage container is not inserted in the squeezing-out mechanism so as to be correctly positioned, this can substantially impair the performance of the squeezing-out mechanism and, therefore, of the system, e.g., due to a malfunction or contamination of the squeezing-out mechanism. For purposes of insertion in the correct position, the storage container can have a determined geometric construction of the flat supporting structure as guide means or orientation means that is congruent to a corresponding geometric construction of a squeezing-out mechanism adapted to the storage container. Alternatively, the storage container can have recesses or projections as guide means or orientation means, with these recesses or projections engaging in projections or recesses, as the case may be, of the squeezing-out mechanism adapted to the storage container.

The flat supporting structure is preferably made of plastic. Accordingly, the storage container according to the invention can be manufactured economically and in various forms with known production methods. Aside from plastic, other materials such as metal, wood or cardboard can be used for producing the flat supporting structure.

At least one of the packagings is formed advantageously as a foil bag which is optionally attached to the flat supporting structure by a material bond. E.g., the at least one packaging or foil bag can be glued or welded to the flat supporting structure. The foil bags can be manufactured in a separate production process and supplied so as to be already filled with the desired component. Subsequently, these foil bags are arranged at the flat supporting structure by the same manufacturer or by the manufacturer of the flat supporting structure. Instead of a foil bag, the packaging in the form of a flat material bag can be fixed by a material bond to the flat supporting structure by its side edges on at least three sides.

At least one of the packagings preferably has a varying volume cross section along a longitudinal axis of the supporting structure. With the variation in volume cross section, the ratio of the components to one another in the course of mixing and, therefore, the material properties of the dispensed multicomponent compound can be adapted through the course of the squeezing-out process. E.g., a large amount of hardener may be required in an application at the start of the curing process of the multicomponent compound and, e.g., during a subsequent filling process, a smaller amount of the hardener is desired in relation to the other component or components. Adapting the composition of the multicomponent compound in this way can be taken into account with the varying volume cross sections without a held in a complex squeezing-out mechanism for dispensing the multicomponent compound.

At least one of the packagings preferably has a shorter length than at least one of the other packagings along a longitudinal axis of the supporting structure. Since it is often the case that not all components are needed at the start of the process for mixing the multicomponent compound, the combination of the individual components is controlled as needed with this construction of the storage container according to the invention without a costly mechanical solution.

A combining chamber is advantageously arranged at one end of the flat supporting structure. In this embodiment of the storage container according to the invention, the components are already combined when they are dispensed at the storage container. Therefore, no special connection devices are needed between the individual packagings of the components and the squeezing-out mechanism. The individual packagings can be connected to the combining chamber on the operative side and under monitored conditions. A mixing element is preferably provided in an exchangeable manner adjacent to the combining chamber, e.g., in a dispensing sleeve. The mixing element is, e.g., a static mixer whose mixing characteristics are adapted to the type of multicomponent compound and its components. During an interruption in work, the components which are usually highly reactive and partially mixed can cure in the dispensing sleeve and, therefore, partially in the mixing element. The components still remaining in the storage container can be used for a further squeezing-out process by exchanging the dispensing sleeve and mixing element.

Different multicomponent compounds, e.g., sealing compounds, gluing compounds, filling compounds, etc., require mixing elements that are designed according to the material characteristics of the components so as to ensure that the individual components are mixed together faultlessly. The storage container according to the invention forms a compact, preferably modular unit which can be used in a plurality of squeezing-out mechanisms. Because of the modular design, the storage container according to the invention or parts thereof can be mass-produced, which lowers manufacturing costs and increases its economic efficiency.

At least one of the packagings is advantageously fastened to the combining chamber by a clamping ring. A connection sleeve is provided at the feed chamber, e.g., for each component, and has a snap-in mechanism for receiving the clamping ring so as to ensure reliable fastening. The open portion of a tubular packaging, e.g., is pushed over the connection sleeve. The clamping ring is then pulled over the outer wall of the packaging in the direction of the feed chamber until the clamping ring engages in the snap-in mechanism and is held in position by it. In a variant of this construction, the free portion of the packaging is inserted into the connection sleeve, and the clamping ring is displaced in the packaging in the direction of the feed chamber until the clamping ring snaps into the snap-in mechanism at the connection sleeve.

The snap-in mechanism has, e.g., a depression which is adapted to the clamping ring and, optionally, a stop, and a projection which is arranged at the free edge of the connection sleeve. The projection is constructed, e.g., so as to project radially and so as to extend at least partly around the circumference of the outer wall or inner wall of the connection piece. The clamping ring pushes this area away radially inward or outward when the clamping ring is joined to the connection sleeve. When the rear edge of the clamping ring in the combining direction passes the projection, the free edge of the connection sleeve resumes its original position, and the clamping ring is fixed in the holding position. The optional stop prevents the clamping ring from being pushed too far onto the connection piece. Alternatively, the connection sleeve can have a plane outer wall and the clamping ring can fix the packaging to the connection sleeve by means of adhesive friction.

In addition, at least one packaging with a rinsing liquid is preferably arranged on the supporting structure. The rinsing liquid is squeezed out before and/or after a pause in work in order to clean the dispensing sleeve and, optionally, the mixing element. In this way, any mutually reacting components in the mixing element are washed out and the mixing element need not be exchanged before the next use. Aside from the ecological advantages of this embodiment, there is a reduction in costs for consumable materials.

The storage container is advantageously enclosed by a removable protective packaging. The protective packaging is preferably adapted to the conditions for the storage of the storage container and protects the component packagings arranged on the flat supporting structure and their contents from external influences such as changing temperatures, air humidity or light. The storage container according to the invention is preferably enclosed by a removable UV-protective packaging. The protective packaging is preferably removed shortly before using the storage container. The protective packaging can be provided with a resealable closure for repeated use of the protective packaging or for repackaging a partially spent storage container.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

FIG. 1 is a side view of a system according to the invention;

FIG. 2 is a detailed view of elements of a first embodiment of a squeezing-out mechanism according to the invention;

In the drawings, identical parts are generally provided with identical reference numerals.

DETAILED DESCRIPTION OF THE PREFERRED EMBODIMENTS

Figure 3:
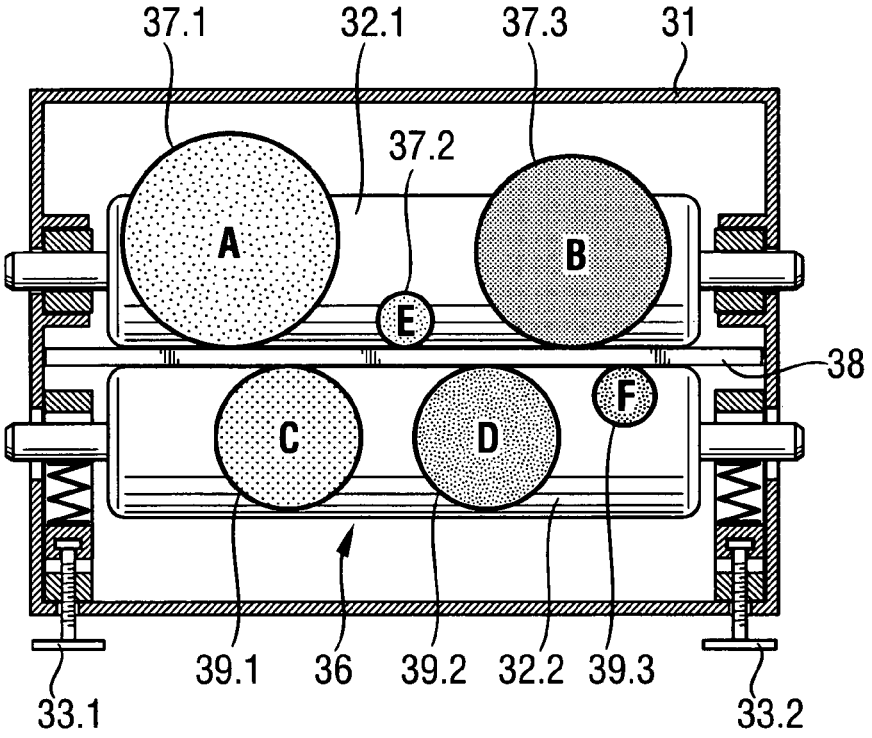
FIG. 3 shows a cross sectional view of another embodiment of a system according to the invention.

A system 1, according to the present invention, which is shown in a side view in FIG. 1, for dispensing a multicomponent compound includes a squeezing-out mechanism formed as a pressing out device 2, and a storage container 11 which is inserted in the squeezing-out device 2. The squeezing-out device 2 has a dispensing opening 4 at one end of the housing 16, and a dispensing sleeve 18 which is arranged at the dispensing opening 4 so as to be exchangeable and is formed as an outlet channel from which the multicomponent compound to be dispensed can be supplied to an application site. A handle 5 is arranged in the area of the end of the housing 16 located opposite from the dispensing opening 4. A first roller 3.1 is provided in the housing 16 of the squeezing-out device 2 for squeezing-out the components arranged on the storage container 11. The first roller 3.1 is movable along the supporting plate 13 of the storage container 11 from an initial position at the height of the handle 5 in the direction of the dispensing opening 4 by means of a motor 6 arranged in the housing 16 as driving means, the supporting plate 13 being constructed as a flat supporting structure. In this embodiment example, the motor 6 is an electric motor which draws the required energy from a storage battery 7.

The roller 3.1 is biased by a compression spring 8.1 in a spring-elastic manner in the direction of the supporting plate 13 of the storage container 11 so that a component in packaging 12.1, e.g., cannot escape in the direction opposite to the squeezing-out direction or in the direction of arrow 17, and the entire amount of the component stored in packaging 12.1, e.g., is used up. The roller 3.1 is connected with the motor 6 by a transmission device 9.1.

In order to dispense the multicomponent compound, the user actuates the release lever 10 at the handle 5 and the roller 3.1 is moved in the direction of the arrow 17 by the motor 6 and by the transmission device 9.1, with the content of the packagings being squeezed out through the dispensing opening 4 and the dispensing sleeve 18. This process is repeated until the packagings are empty. The roller 3.1 is moved back into the initial position again by the motor 6 and the used storage container 11 is exchanged for a new storage container. The system is then available for use again.

In addition to the first roller 3.1, an optional second roller 3.2 is shown in dashed lines in FIG. 1. The second roller 3.2 is likewise biased by a compression spring 8.2 in a spring-elastic manner in the direction of the supporting plate 13 of the storage container 11. The second roller 3.2 is driven by the motor 6 and by an additional transmission device 9.2. The rollers 3.1 and 3.2 are controllable independently from one another. In addition to motor 6, a second motor (not shown) can be provided in the squeezing-out device 2, so that each roller is driven by a separate motor. The control of the individual rollers 3.1 and 3.2 is carried out, e.g., mechanically or electronically.

A detailed view of elements of a first embodiment of a squeezing-out mechanism according to the invention is shown in FIG. 2. The storage container 21 has a plate 22 serving as flat supporting structure and packagings (only packaging 23.1 is shown) arranged on the latter. In FIG. 2, only individual functional parts of the entire squeezing-out device are shown, these functional parts being substantially enclosed by a housing, not shown. The squeezing-out process is carried out with the first roller 26.1 which is moved in the direction of the plate 22 by a spring force. In order that the plate 22 of the storage container 21 is not subjected to severe bending loads by the spring-biased roller 26.1 and can, accordingly, be formed with a reduced thickness which reduces the consumption of the material, a second roller 26.2 which is movable synchronously with the first roller 26.1 is provided in the embodiment. The second roller 26.2 is likewise spring-biased in a spring-elastic manner in the direction of the plate 22 of the storage container 21.

A first closing device 28.1 and a second closing device 28.2 are provided at the squeezing-out device, not shown in more detail, in the area of the dispensing opening 27. The first closing device 28.1 acts on a first side of the plate 22 of the storage container 21 and the second closing device 28.2 acts on the side of the plate 22 of the storage container 21 located opposite from the first side. During a pause in operation or, e.g., after removing a closure of the packagings, the latter can be closed by closing devices 28.1 and 28.2 even when packagings are arranged on both sides of the plate 22. The closing devices 28.1 and 28.2 are controlled separately from each other.

FIG. 3 shows a cross-sectional view of another embodiment of a system according to the invention. A storage container 36 is inserted in the housing 31, with three packagings 37.1, 37.2 and 37.3 being arranged at one side of the plate 38 and three packagings 39.2, 39.2 and 39.3 being arranged at the other side of the plate 38. A component A, E and B and a component C, D and F, respectively, is stored in each of the packagings 37.1, 37.2, 37.3, and 39.1, 39.2, 39.3 for producing a multicomponent compound.

In order to press out the components A, E and B, a first roller 32.1, which is supported in a rigid guide, is arranged in the housing 31 of the squeezing-out device. In order to press out components C, D and F, a second roller 32.2, which is biased in a spring-elastic manner in the direction of the plate 38, is arranged in the housing 31 of the squeezing-out device. The spring-elastic action upon the second roller 32.3 can be adapted by adjusting mechanisms 33.1 and 33.2. Because of the modularity of the entire system, storage containers with thicknesses of the plate 38 which serves as flat supporting structure, different than that of the storage container 36 are used in one and the same squeezing-out device, e.g., A faultless squeezing-out is also achieved in this construction of the squeezing-out device due to the adjustability of the second roller 32.2.

The first roller 32.1 is controlled and is driven separately from the second roller 32.2 in this embodiment. Accordingly, e.g., first components A, E and B can be squeezed out by of the first roller 32.1, and then components C, D and F can be squeezed out by the second roller 32.2. Further, all components can be squeezed out with a movement of the rollers 32.1 and 32.2 which is substantially simultaneous or offset in time in order to produce a multicomponent compound from six components. The quantity of six components is shown by way of example in this embodiment. Depending on the type and composition of the multicomponent compound, more or less than six components are provided at the plate 38 of the storage container.

Figure 4:
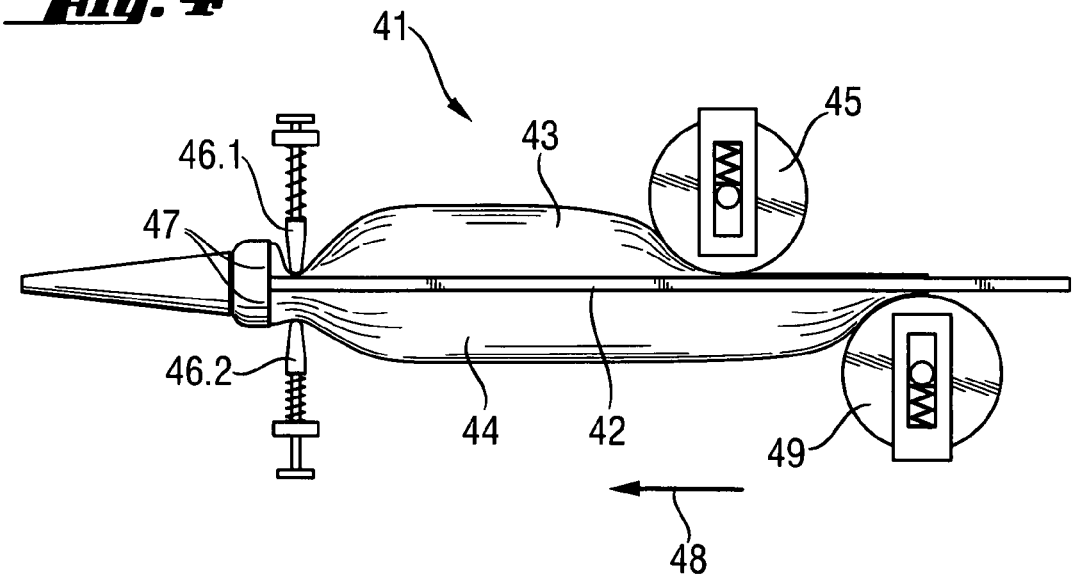
FIG. 4 is a detailed view of elements of another embodiment of a squeezing-out mechanism according to the invention.

FIG. 4 shows a detailed view of elements of another embodiment of a squeezing-out mechanism according to the invention. Packagings (in this case, packagings 43 and 44) are arranged on both sides of the plate 42 of the storage container 41. In this view, as in FIG. 2, only individual functional parts of the squeezing-out device are shown and are substantially enclosed in a housing, not shown. The components for the multicomponent compound are arranged at the upper side of the plate 42. A rinsing liquid is provided in the packaging 44 on the opposite, lower side of the plate 42 with reference to the drawing. After the desired amount of multicomponent compound has been dispensed from the dispensing opening 47 by the roller 45, the packaging 43 and the other packagings (not shown here) arranged on the same side of the plate, are closed by the closing device 46.1. In this way, the components which are not yet squeezed out are prevented from continuing to flow in an undesirable manner. The second closing device 46.2 is then opened, and a determined amount of rinsing liquid is dispensed in the squeezing-out direction (in the direction of arrow 48) by the second roller 49 for cleaning the dispensing opening and additional elements connected thereto. The second closing device 46.2 is then closed again and the system is ready for further use.

Figure 5:
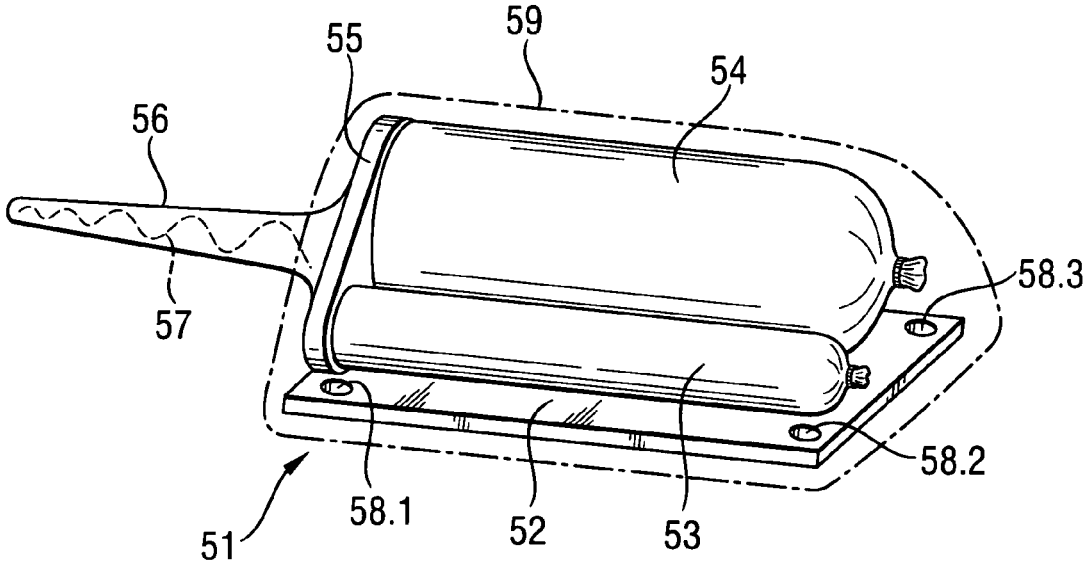
FIG. 5 is a perspective view of a first embodiment of a storage container according to the invention.
Figure 6:
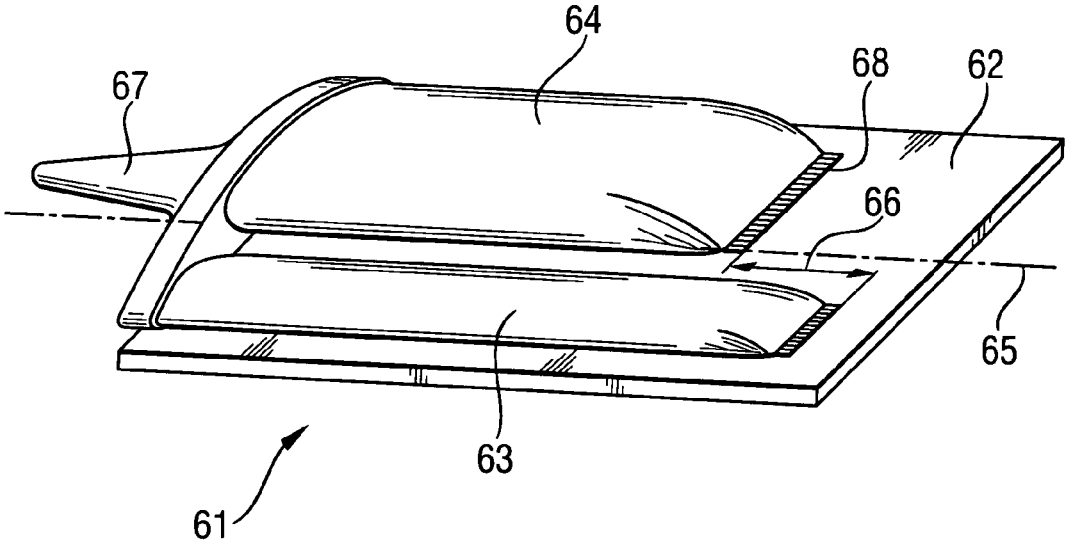
FIG. 6 is a perspective view of a second embodiment of a storage container according to the invention.
Figure 7:
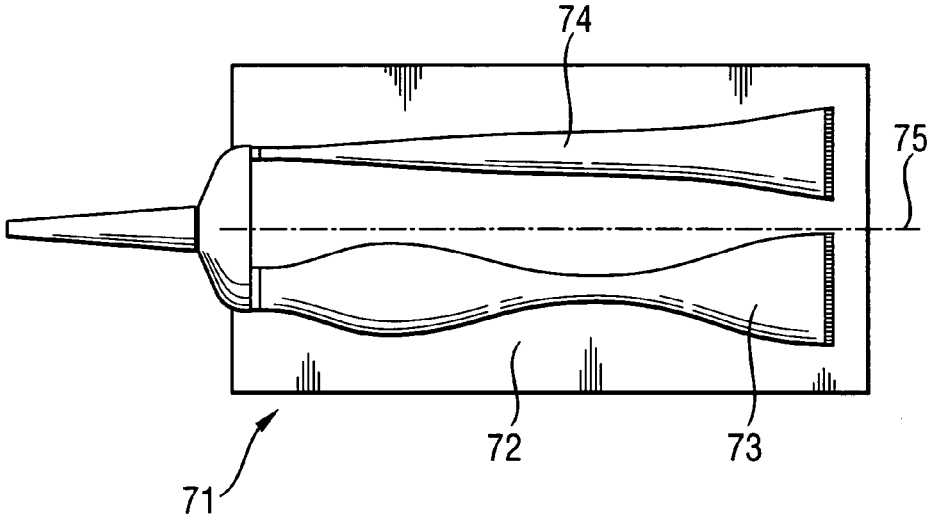
FIG. 7 is a side view of a third embodiment of a storage container according to the invention.

FIGS. 5 to 7 show three embodiments of a storage container according to the invention. The first embodiment of the storage container 51 shown in FIG. 5 comprises a plate 52 as flat that serves a supporting structure. A first foil bag 53 and a second foil bag 54 are arranged at the plate 52. The second foil bag 54 has a greater volume cross section than the first foil bag 53. A combining chamber 55 is provided at one end of the plate 52, the squeezed out components stored in the two foil bags 53 and 54 being combined therein. A dispensing sleeve 56, in which a mixing element 57 is provided for mixing the components, adjoins the combining chamber 55. The dispensing sleeve 56 and the mixing element 57, which is arranged therein, are replaceably secured, e.g., with a screw thread, at the combining chamber 55. The individual components are usually highly reactive so that they often cure in the dispensing sleeve 56 during a pause in work, and are rendered unusable for further use. The rest of the components remaining in the foil bags 53 and 54 during a pause in work can be dispensed by exchanging the dispensing sleeve 56 and the mixing element 57 arranged therein.

The plate 52 has recesses 58.1, 58.2 and 58.3 in its corner areas as guiding and orientation means which can be guided together by cams in a squeezing-out device, not shown, so that the storage container 51 can only be inserted into the squeezing-out device in the correct position. The storage container 51 is surrounded by a removable protective packaging 59 which protects the entire storage container 51 from external influences during interim storage. Before inserting the storage container 51 into a squeezing-out device, the protective packaging 59 is removed, e.g., by tearing it off the storage container 51. The material and characteristics of the protective packaging 59 are determined depending on the sensitivity of the components packed in the foil bags 53 and 54 and the protection of the components provided already by the material of the foil bags 53 and 54. E.g., the protective packaging 59 protects the storage container from UV radiation.

A second embodiment of a storage container according to the invention is shown in FIG. 6. The storage container 61 comprises a plate 62 to which are welded a first packaging 63 and a second packaging 64, each with one component of a two-component compound. The packaging 64 is shorter than packaging 63 with reference to the longitudinal axis 65. At the start of the squeezing-out process, only the component in the first packaging 63 is dispensed through the dispensing sleeve 67 along the excess length 66. As soon as the squeezing-out mechanism has reached the rear edge 68 of the second packaging 64, both packagings 63 and 64 and, therefore, both components of the two-component compound are squeezed out as the squeezing-out process continues.

A third embodiment of a storage container according to the invention is shown in FIG. 7. The storage container 71 has two packagings 73 and 74 arranged at its plate 72 which have a varying volume cross-section along the longitudinal axis 75 of the plate 72. By means of this arrangement of the packagings 73 and 74, the characteristics of the multicomponent compound to be produced can be controlled over the course of the squeezing-out process corresponding to the characteristics and the supplied amount of the individual components in packagings 73 and 74.

Figure 8:
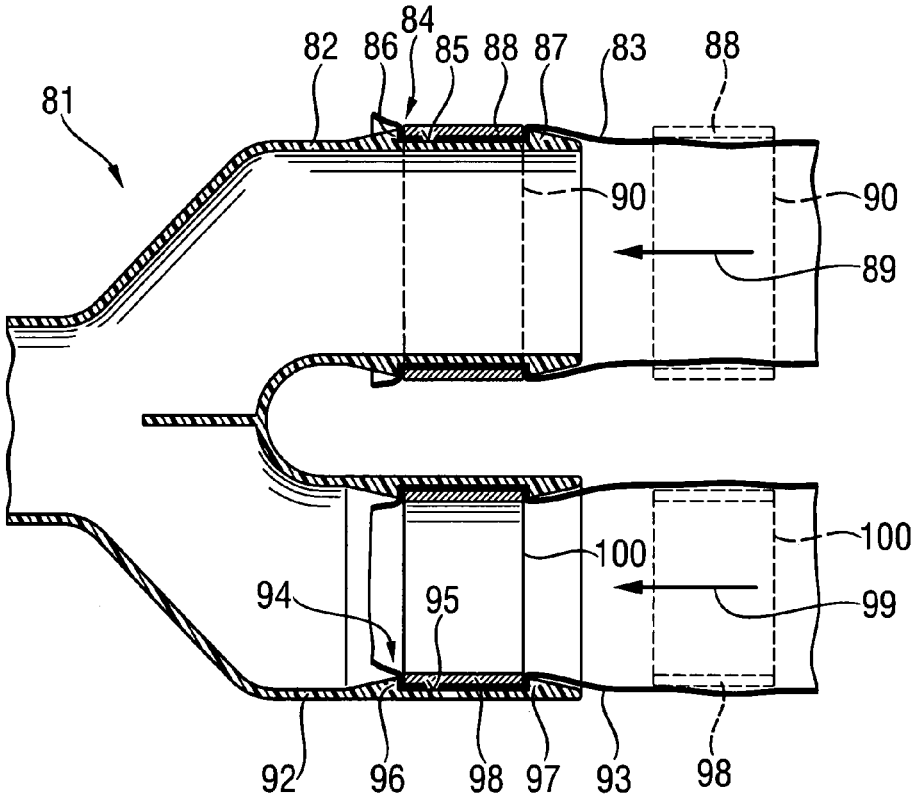
FIG. 8 is a cross-sectional view illustrating fastening of the component packagings to the combining chamber.

FIG. 8 shows a detailed cross-section of two variants for fastening the component packagings to the combining chamber. E.g., two connection pieces 82 and 93 for the connection of packaging 83 and packaging 93 are formed at the combining chamber 81. One fastening variant is represented by the connection of packaging 83 to the connection piece 82, and another fastening variant is shown by the connection of packaging 92 to the connection piece 92. The fastenings show two of many possible variants; in practice, the packagings are usually fastened to the connection pieces in the same way at all connection pieces of a combining chamber.

A snap-in mechanism 84 is connected to the connection piece 82. The snap-in mechanism 84 comprises a depression 85 which is arranged around the outer circumference of the connection piece 82, a stop 86 which projects outward and is arranged along the entire circumference, and a holding projection 87 which projects outward and is arranged along the entire circumference. The packaging 83 is pulled over the free end of the connection piece 82 and the snap-in mechanism 84. The other, free end of the packaging 83 is drawn through the clamping ring 88. The clamping ring 88 is pulled in the direction of arrow 89 from this intermediate position (shown in dashed lines). When the free end of the connection piece 82 is reached, this free edge and therefore the projection 87 are bent radially inward until the rear edge 90 of the clamping ring 88, with reference to the direction of arrow 89, has passed this projection 87. The free end of the connection piece 82 returns to its original position and fixes the clamping ring 88 in the holding position (shown in solid lines). The clamping ring 88 is dimensioned in such a way that the free end of the packaging 83 is held fixedly at the connection piece 82.

A variant of the snap-in mechanism 84 described above is shown at the connection piece 92. The snap-in mechanism 94 formed at the connection piece 92 includes a depression 95 which is arranged around the inner circumference of the connection piece 92, a stop 96 which projects inward and is arranged along the entire circumference, and a holding projection 97 which projects inward and is arranged along the entire circumference. The packaging 93 is pulled into the free end of the connection piece 92 and the snap-in mechanism 84. The clamping ring 98 is inserted into the packaging 93 through the free end of the packaging 93. The clamping ring 98 is pulled in the direction of arrow 99 from an intermediate position (shown in dashed lines). When the free end of the connection piece 92 is reached, this free edge and, therefore, the projection 97 are bent radially outward until the rear edge 100 of the clamping ring 98, with reference to the direction of arrow 99, has passed this projection 97. The free end of the connection piece 92 returns to its original position and fixes the clamping ring 98 in the holding position (shown in solid lines). The clamping ring 98 is dimensioned in such a way that the free end of the packaging 93 is held fixedly at the connection piece 92.

It is noted in summary that a reusable system is provided for dispensing more than two components of a multicomponent compound. Various types of multicomponent compounds can be dispensed by one and the same squeezing-out mechanism. Because of the modular design of the storage container and/or the wide field of application of the squeezing-out mechanism, both elements of the system can be manufactured in large quantities so that they can be produced economically. In addition to this flexibility in this type of application, the dispensing ratios of the individual components can vary with the system and particularly with the storage container, so that any types and compositions of multicomponent compounds can be dispensed.

Though the present invention was shown and described with references to the preferred embodiments, such are merely illustrative of the present invention and are not to be construed as a limitation thereof and various modifications of the present invention will be apparent to those skilled in the art. It is therefore not intended that the present invention be limited to the disclosed embodiments or details thereof, and the present invention includes all variations and/or alternative embodiments within the spirit and scope of the present invention as defined by the appended claims.

What is claimed is:

1. A storage container for a system for dispensing at least two components of a multicomponent mass and including a squeezing-out device (2) having a dispensing opening (4) and at least one rolling roller (3.1, 3.2; 26.1, 26.2; 32.1; 32.2; 45, 49) for dispensing the at least two components, the storage container (11; 21; 36; 41; 51; 61; 71) comprising flat support means (13; 22; 38; 42; 52; 62; 72) for supporting separate packagings of the at least two components, wherein at least one of the packagings of the at least two components (12/1; 23.1; 37.1, 37.2, 37.3, 39.1, 39.2, 39.3; 43, 44; 53, 54; 63, 64; 73, 74) is formed as a foil bag, and wherein the foil bag is material-bonded to the flat support means (13; 22; 38; 42; 52; 62; 72).

2. A storage container for a system for dispensing at least two components of a multicomponent mass and including a squeezing-out device (2) having a dispensing opening (4) and at least one rolling roller (3.1, 3.2; 26.1, 26.2; 32.1; 32.2; 45, 49) for dispensing the at least two components, the storage container (11; 21; 36; 41; 51; 61; 71) comprising flat support means (13; 22; 38; 42; 52; 62; 72) for supporting separate packagings of the at least two components, wherein with reference to a longitudinal axis (65) of the flat support means (62), one (64) of the packagings of the at least two components has a shorter length than another (65) of the packagings.

3. A storage container for a system for dispensing at least two components of a multicomponent mass and including a squeezing-out device (2) having a dispensing opening (4) and at least one rolling roller (3.1, 3.2; 26.1, 26.2; 32.1; 32.2; 45, 49) for dispensing the at least two components, the storage container (11; 21; 36; 41; 51; 61; 71) comprising flat support means (13; 22; 38; 42; 52; 62; 72) for supporting separate packagings of the at least two components, wherein a combining chamber (55, 81) is provided at one of ends of the flat support means (52; 62; 72).

4. A storage container according to claim 3, wherein the flat support means (13; 22; 38; 42; 52; 62; 72) is formed of a plastic material.

5. A storage container according to claim 3, wherein a mixing element (57) adjoins the combining chamber (55).

6. A storage container according to claim 3, further comprising a clamping ring (88, 93) for securing at least one of the packagings (83, 93) to the combining chamber (81).

7. A storage container according to claim 3, wherein in addition to the packagings of the at least two components, at least one packaging (44) with a rinsing fluid is arrangeable on the flat support means (42).

* * * * *